US005957609A

United States Patent [19]

Morita et al.

[11] Patent Number: 5,957,609

[45] **Date of Patent: *Sep. 28, 1999**

[54] APPLICATOR

[75] Inventors: Masaaki Morita, Sawa-gun; Yasuyuki Iwase, Fujioka; Atsunori Satake, Tano-gun; Tadashi Koriki, Sawa-gun; Masao Hashi, Higashiokitama-gun, all of Japan

[73] Assignee: Mitsubishi Pencil Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/506,680

[22] Filed: Jul. 25, 1995

[30] Foreign Application Priority Data

| | | | |
|---|---|---|---|
| Aug. 19, 1994 | [JP] | Japan | 6-195179 |
| Sep. 20, 1994 | [JP] | Japan | 6-224401 |
| Mar. 1, 1995 | [JP] | Japan | 7-041640 |

[51] Int. Cl.[6] ..... B43K 7/00; B43K 7/10

[52] U.S. Cl. ..... 401/214; 401/212

[58] Field of Search ..... 401/214, 212, 401/216

[56] References Cited

U.S. PATENT DOCUMENTS

| | | | |
|---|---|---|---|
| 392,046 | 10/1888 | Loud | 401/212 |
| 538,492 | 4/1895 | Askew | 401/212 |
| 2,208,588 | 7/1940 | LaForest | 401/212 |
| 2,485,224 | 10/1949 | Wahl | 401/212 |
| 3,010,139 | 11/1961 | Parker | 401/216 X |
| 5,056,949 | 10/1991 | Petrillo . | |

FOREIGN PATENT DOCUMENTS

| | | | |
|---|---|---|---|
| 461.361 | 12/1913 | France . | |
| 947926 | 7/1949 | France | 401/212 |
| 965.140 | 9/1950 | France . | |
| 2665649 | 2/1992 | France . | |
| 329.628 | 2/1993 | France . | |
| 703046 | 1/1941 | Germany . | |
| 1209912 | 1/1966 | Germany . | |
| 4304910 | 8/1994 | Germany | 401/214 |
| 500193 | 11/1954 | Italy | 401/214 |
| 52-39228 | 3/1977 | Japan . | |
| 193578 | 12/1982 | Japan . | |
| 51480 | 7/1993 | Japan . | |
| 1175860 | 1/1970 | United Kingdom . | |

*Primary Examiner*—Steven A. Bratlie
*Attorney, Agent, or Firm*—Darby & Darby

[57] ABSTRACT

An applicator includes: a barrel body; a holder having a ball house with an ejecting opening at front end for allowing the liquid from the barrel body to flow out; a ball held in the ball house, as being partially exposed to the outside through the ejecting opening; a spherical evading member disposed on the rear side of the ball and having a smaller diameter than that of the ball; a ball seat disposed in the rear part of the ball house, for receiving the rear side of the evading member; a liquid conduit provided in an approximately central part of the ball seat; longitudinal grooves formed on the inside wall of the liquid conduit; and a pressing means disposed through the liquid conduit for urging the evading member forward.

12 Claims, 11 Drawing Sheets

APPLICATOR

BACKGROUND OF THE INVENTION (1) Field of the Invention

The present invention relates to an applicator of a liquid, and particularly relates to an applicator which stores an applying liquid such as a correcting liquid, water-color or oil-based ink, a cosmetic etc., and which applies the liquid onto a surface such as a sheet of paper.

(2) Description of the Prior Art

Japanese Utility Model Application Laid-Open Hei 5 No. 51,480 discloses an applicator which includes: a barrel member (applying liquid container) storing a liquid such as a correcting liquid as an applying liquid; a holder (tip) having a ball house with an ejecting opening at the front end thereof through which the liquid is ejected; and a ball (spherical applying member) which is held in the ball house and urged forward so that part of the ball projects outside from the ejecting opening.

The ball is held in the ball house in such a manner that it abuts an inward edge at the front part of the ball house while being movable in a separating direction from the edge. As the ball abuts against or separates from the edge, the ejecting opening is closed or opened.

Formed at the rear part of the ball house is a ball seat which supports the rear side of the ball when the ball is pressed against an applied surface and moved rearward. A liquid conduit for conducting the liquid from the barrel body to the ball house is formed substantially in a center of the cross-section of the ball seat. A moving piece (pressing means) urged by a spring is disposed through the liquid conduit, and its front end abuts the rear side of the ball to elastically press the ball forward.

When a user uses a conventional applicator thus configured and causes the ball to press an applied surface, the ejecting opening is released while the rear side of the ball is brought into contact with the ball seat. In this condition, as the ball is made to roll, it is possible to apply the liquid in desired places on a surface, referred to herein as the applied surface.

Meanwhile, in the aforementioned conventional applicator, when the ball is pressed against the applied surface and forced to move backward, the rear side of the ball blocks the liquid conduit, therefore it cannot be expected that the liquid is well supplied through the liquid conduit. Accordingly, some or several longitudinal grooves are formed on the inner wall of the liquid conduit, along the conducting direction, so that small clearances formed between the longitudinal grooves and the ball may allow the liquid to enter the ball house.

However, when the user performs application with the device by rolling the ball over the applied surface, the ball will rotate with the rear side thereof pressed against the ball seat. Therefore, as the applicator is repeatedly used, the ball seat wears out and consequently the longitudinal grooves, which are the only supplying channel of the liquid, could be blocked, preventing supply of the liquid into the ball house.

The above problems stand out especially when the viscosity of the liquid used is low or when the liquid contains pigments.

That is, when the liquid has high viscosity, the liquid itself effectively functions as a lubricant for alleviating the abrasion of the ball seat. On the other hand, if the viscosity of a liquid used is low, the lubricating power is ineffective. Therefore, the ball seat is highly susceptible to wear.

Specifically, if the viscosity of a liquid is less than 30 cps, the abrasion of the ball seat becomes a major factor in causing liquid delivery deficiencies.

When the applying liquid is a correcting liquid containing organic and/or inorganic pigments or an ink containing pigments etc., presenting opacity, the liquid must contain titanium oxide and the like, which behave as polishing agents in the aforementioned wearing process, thus further promoting the ball seat to be worn out.

Since some liquids used for devices of this kind contain pigments which are susceptible to sedimentation, an agitating member or members, such as balls, rods etc., are provided for agitating the liquid inside the barrel body. If such an applicator is stored for a prolonged period of time, the sediment adheres to the ball seat and thereabout to thereby block the channels formed by the aforementioned grooves. When the applicator is repeatedly used in this manner, reduction of the ejecting amount of the liquid will be accelerated by the combination of the wearing process and the blockage by the sediment.

To solve these problems, the inner diameter of the ball house may be enlarged in order to increase the clearance between the ball and the inner wall of the ball house. This configuration assures large opening sections of the longitudinal grooves, making it possible to prevent the passage of the liquid from being clogged even if the ball seat has been worn out. In this case, however, the outside dimension of the holder must become large as the inner diameter of the ball house is made large. Therefore, the size of the holder becomes large relative to the ball size, and consequently the device becomes difficult to handle when characters etc., are to be written or small parts are to be applied.

Further, there is a concern that the clearance between the ball and the ball house will become larger than needed. In such a case, the liquid would flow out excessively, so that it would be impossible to eject the liquid in a proper amount.

The above problems occur in the same way in the applicator disclosed in Japanese Utility Model Application Laid-Open Sho 57 No. 193,578. A ball-point pen disclosed in Japanese Utility Model Application Laid-Open Sho 52 No. 39,228 has a pair of balls arranged in the length-wise direction inside a ball holding portion (corresponding to the aforementioned ball house) in order to reduce the abrasion of a ball receiving portion (corresponding to the aforementioned ball seat). In this configuration, however, the balls are held in close contact with projections formed on the inner wall of the ball holding portion, so that when the two balls are pressed backward at writing, the inner ball completely blocks the liquid conduit formed in the center of the ball receiving portion. As a result, the only passage of supplying ink (corresponding to the aforementioned liquid) assured is ink conducting grooves (corresponding to the aforementioned longitudinal grooves), which cannot allow sufficient supplying of ink. Further, in the configuration disclosed in Japanese Utility Model Application Laid-Open Sho 52 No. 39,228, the sealing performance at the tip opening portion (corresponding to the ejecting opening) is dependent upon the clearance between the ball and the opening portion. That is, for some types of liquids, closing and opening of the opening portion cannot be effected well enough, possibly causing deficiencies such as liquid leaking.

SUMMARY OF THE INVENTION

The present invention has been achieved in view of what is discussed above as to the conventional applicators, and it is therefore an object of the present invention to provide an applicator which is able to prevent reduction of the ejecting amount of the liquid due to repeated use of the applicator and which is able to eject a proper amount of the applying liquid smoothly and reliably effect opening and closing of the ejecting opening.

In order to attain the above object, the present invention is configured as follows:

In accordance with a first feature of the present invention, an applicator comprises:

a barrel body storing a liquid therein; a holder having a ball house with an ejecting opening at a front end for allowing the liquid from the barrel body to flow out;

a ball rotatably held in the ball house, the ball being partially exposed to the outside through the ejecting opening, so as to serve as an applying point, the ball being held to be movable from a first position abutting the inner wall around the ejecting opening to a second position separated from the abutting position, whereby the ejecting opening is closed and opened, wherein, when part of the ball is pressed on an applied surface, the liquid is ejected from a gap between the ejecting opening and the ball to thereby apply the liquid on the applied surface; an evading member disposed on the rear side of the ball inside the ball house, the evading member having a smaller outside dimension than the diameter of the ball and being in contact with the rear side of the ball and movable together with the ball;

a ball seat disposed in the rear part of the ball house, for receiving the rear side of the evading member when part of the ball is pressed against an applied surface so that the ball is moved backward;

a liquid conduit provided in an approximately central part of the ball seat, for conducting the liquid from the barrel body into the ball house;

a plurality of longitudinal grooves radially arranged about the liquid conduit as a center, being formed on the inner wall of the liquid conduit along the conducting direction of the liquid;

and a pressing means disposed through the liquid conduit and abutting the rear side of the evading member so as to urge the ball and the evading member forward.

In accordance with a second feature of the present invention, an applicator comprises:

a barrel body storing a liquid therein;

a holder having a ball house with an ejecting opening at a front end for allowing the liquid from the barrel body to flow out;

a ball rotatably held in the ball house, the ball being partially exposed to the outside through the ejecting opening, so as to serve as an applying point, the ball being held to be movable from a first position abutting the inner wall around the ejecting opening to a second position separated from the abutting position, whereby the ejecting opening is closed and opened, wherein, when part of the ball is pressed on an applied surface, the liquid is ejected from a gap between the ejecting opening and the ball to thereby apply the liquid on the applied surface;

an evading member disposed on the rear side of the ball inside the ball house, the evading member having a smaller outside dimension than the diameter of the ball and being in contact with the rear side of the ball and movable together with the ball;

the ball house being composed of: a large-diameter ball house having a greater inside diameter than that of the ball, for holding the ball; and a small-diameter ball house, which holds the evading member, is continuously joined from the rear end of the large-diameter ball house and has an inside diameter smaller than that of the larger-diameter ball house and greater than the outside diameter of the evading member;

a ball seat disposed in the rear part of the small-diameter ball house, for receiving the rear side of the evading member when part of the ball is pressed against an applied surface and so that the ball is moved backward;

a liquid conduit provided in an approximately central part of the ball seat, for conducting the liquid from the barrel body into the ball house;

a plurality of longitudinal grooves radially arranged along the conducting direction of the liquid about the liquid conduit as a center, the grooves being formed on the inner wall of the liquid conduit and the inner wall of the small-diameter ball house; and a pressing means disposed through the liquid conduit and abutting the rear side of the evading member so as to urge the ball and the evading member forward.

In accordance with a third feature of the present invention, an applicator comprises:

a barrel body storing a liquid therein;

a holder having a ball house with an ejecting opening at a front end for allowing the liquid from the barrel body to flow out;

a ball rotatably held in the ball house, the ball being partially exposed to the outside through the ejecting opening, so as to serve as an applying point, the ball being held to be movable from a first position abutting the inner wall around the ejecting opening to a second position separated from the abutting position, whereby the ejecting opening is closed and opened, wherein, when part of the ball is pressed on an applied surface, the liquid is ejected from a gap between the ejecting opening and the ball to thereby apply the liquid on the applied surface;

the ball house being defined by a smooth, cylindrical surface having an inside diameter of greater than the diameter of the ball;

a spherical evading member disposed on the rear side of the ball inside the ball house, the evading member having an approximately equal diameter to that of the ball and being in contact with the rear side of the ball and movable together with the ball;

a ball seat disposed in the rear part of the ball house, for receiving the rear side of the evading member when part of the ball is pressed against an applied surface so that the ball is moved backward;

a liquid conduit provided in an approximately central part of the ball seat, for conducting the liquid from the barrel body into the ball house;

a plurality of longitudinal grooves radially arranged about the liquid conduit as a center, being formed on the inner wall of the liquid conduit along the conducting direction of the liquid; and a pressing means disposed through the liquid conduit and abutting the rear side of the evading member so as to urge the ball and the evading member forward.

In accordance with a fourth feature of the present invention, an applicator comprises:

a barrel body storing a liquid therein;

a holder having a ball house with an ejecting opening at a front end for allowing the liquid from the barrel body to flow out;

a ball rotatably held in the ball house, as being partially exposed to the outside through the ejecting opening, so as to serve as an applying point, the ball being held to be movable from a first position abutting the inner wall around the ejecting opening to a second position separated from the abutting position, whereby the ejecting opening is closed and opened, wherein, when part of the ball is pressed on an applied surface, the liquid is ejected from a gap between the ejecting opening and the ball to thereby apply the liquid on the applied surface;

a spherical evading member disposed on the rear side of the ball inside the ball house, the evading member having a smaller diameter than the diameter of the ball and being in contact with the rear side of the ball and movable together with the ball;

the ball house being composed of: a large-diameter ball house having a greater inside diameter than the diameter of the ball, for holding the ball; and a small-diameter ball house, which holds the evading member, is continuously joined from the rear end of the large-diameter ball house and has an inside diameter smaller than that of the larger-diameter ball house and greater than the diameter of the evading member, each of the large-diameter ball house and the small-diameter ball house being defined by a substantially cylindrical, smooth surface;

a ball seat disposed in the rear part of the ball house, for receiving the rear side of the evading member when part of the ball is pressed against an applied surface so that the ball is moved backward;

a liquid conduit provided in an approximately central part of the ball seat, for conducting the liquid from the barrel body into the ball house;

a plurality of longitudinal grooves radially arranged about the liquid conduit as a center, being formed on the inner wall of the liquid conduit along the conducting direction of the liquid; and a pressing means disposed through the liquid conduit and abutting the rear side of the evading member so as to urge the ball and the evading member forward.

It is effective for each of the above applicators of the present invention to satisfy at least one of the following conditions: the liquid has viscosity of less than 30 cps; the liquid contains pigments while an agitating means for agitating the liquid is provided inside the barrel body; and the barrel body is a flexible tank for storing an applying liquid.

In accordance with the first feature of the present invention thus configured, when part of the ball is pressed onto an applied surface, the evading member of the smaller diameter moves rearward together with the ball and abuts the ball seat. Therefore, it is possible to establish a greater area of opening sections of the longitudinal grooves in the ball house as compared to the conventional applicator in which a ball of the greater diameter is made to directly abut the ball seat. Further, since the use of the evading member of the smaller diameter creates a greater clearance between the evading member and the inner wall of the ball house, the liquid having passed through the longitudinal grooves flow well through the clearance to the ball.

Since the evading member of the smaller diameter than the ball abuts the ball seat, the reduction of the area of the opening sections of the longitudinal grooves due to the wear of the ball seat caused by repeated applications is smaller than that in the aforementioned conventional applicator.

Accordingly, without modifying the diameter of the ball and the inside diameter of the ball house, therefore without increasing the outside dimension of the holder, it is possible to improve the flow of the liquid and to prevent the reduction of the ejecting amount of the liquid due to the abrasion of the ball seat. It should be noted that the clearance between the ball and the inner wall of the ball house can be selected to be in conformity with the fluidity of a liquid used, so that the liquid can be ejected in a desired amount.

In accordance with the second feature of the present invention, as mentioned with respect to the first configuration, when part of the ball is pressed onto an applied surface and the evading member of the smaller diameter moves rearward together with the ball and abuts the ball seat, it is possible to establish a greater area of opening sections of the longitudinal grooves in the ball house as compared to the conventional applicator in which a ball of the greater diameter is made to directly abut the ball seat. Further, the flow of the liquid around the evading member can be improved by both the liquid conduit and the plurality of longitudinal grooves formed on the inner wall of the liquid conduit as well as the inner wall of the small-diameter ball house.

Since the evading member is held in the small-diameter ball house, the evading member will tend to be aligned with the center of the ball on the center axis of the barrel body. Accordingly, the evading member will not largely deviate from alignment with the center axis at the time of applying, so that it is possible for the user to apply the liquid with confidence. Since the ball is not displaced to one side of the center axis, but moved correctly forward to abut the inner wall of the ejecting opening, it is possible to reliably confine the ejecting opening. In contrast, in a case where, for example, a ball and an evading member are held in a ball house having a constant inner diameter associated with the diameter of the ball, the evading member is likely to be displaced in a radial direction in the ball house. Accordingly, there is a concern that performance in applying might be degraded or the sealing performance at the ejecting opening might be deteriorated.

As stated previously, in accordance with the invention, since the evading member having a diameter smaller than the ball abuts the ball seat, the reduction of the area of the opening sections of the longitudinal grooves due to the wear of the ball seat caused by repeated applications is smaller than that in the aforementioned conventional applicator.

Accordingly, without modifying the diameter of the ball and the inside diameter of the ball house, therefore without increasing the outside dimension of the holder, it is possible to improve the flow of the liquid and to prevent the reduction of the ejecting amount of the liquid due to the abrasion of the ball seat. Still, it is possible to secure the closing and opening of the ejecting opening with the ball.

It should be noted that the clearance between the ball and the inner wall of the large-diameter ball house can be selected to be in conformity with the fluidity of a liquid used, so that the liquid can be ejected in a desired amount.

In accordance with a third feature of the invention, when part of the ball is pressed onto an applied surface at the time of applying, the evading member together with the ball moves rearwardly and abuts the ball seat. In this condition, as the ball is moved while pressed against the applied surface, the ball rotates but the evading member hardly rotates for the following reasons 1) to 3):

1) Liquid between the ball and the evading member serves as a lubricant, to thereby reduce the frictional force at the contact point between the two.

2) The spherical evading member comes in contact with the ball at a single point.

3) Both the ball and the evading member are spherical, thus, it is possible to readily produce these parts with high sphericity to achieve improved surface smoothness in both elements. Therefore it is possible to further reduce the friction therebetween.

Because of the above reasons 1) to 3), the ball rotates, skidding relative to the evading member, so that almost no rotation is transferred to the evading member. As a result, the ball seat is hardly worn down by the evading member, therefore the area of opening sections of the longitudinal grooves formed on the inside wall of the liquid conduit will vary little.

Since the ball house is defined by a substantially cylindrical smooth surface having an inside diameter greater than the diameter of the ball, the evading member and the ball will be able to move not only in the aforementioned abutting/separating direction (to be referred to as a longitudinal direction) but also in directions at right angles with the longitudinal direction (to be referred to as a lateral direction). For this reason, when part of the ball is pressed onto an applied surface at the time of applying and therefore the ball is moved backward, the evading member will abut the inside wall of the ball house and the ball seat with its center offset from the central axis of the ball house in a lateral direction.

As a result, the opening brim of the liquid conduit will not be completely blocked by the rear side of the evading member. Accordingly, the supplying of the liquid to the ball and the ejecting opening is accomplished not only through the longitudinal grooves but also through the liquid conduit, whereby a further improved flowing condition of the liquid can be secured.

All the effects described above make it possible for the applicator to maintain an initially designated ejecting flow of the liquid even after usage for a prolonged period of time.

In accordance with the third feature of the present invention, since a pressing member abutting the rear side of the evading member and urging the evading member and the ball forward is disposed through the liquid conduit, the ball as well as the evading member is pressed forward. This improves the sealing performance between the ball and the ejecting opening, thus making it possible to reliably effect the closing and opening of the ejecting opening.

The operation of the fourth configuration of the invention is similar to that of the third configuration of the invention. Further, in accordance with the fourth feature, since the ball house is composed of a large-diameter ball house for holding a ball and a small-diameter ball house for holding an evading member, it is possible to regulate the amount of the deviation from the central axis of the evading member in the lateral direction by selecting only the inside diameter of the small-diameter ball house and the diameter of the evading member, independently of the ball and the large-diameter ball house.

Accordingly, by increasing only the amount of deviation of the evading member in the lateral direction, without regard to the amount of deviation of the ball in the lateral direction (a factor of affecting tactility in applying), it is possible to force the evading member farther aside in the lateral direction so as to abut the inner wall of the small-diameter ball house and the ball seat, whereby an increased area of the unblocked portion of the liquid conduit or an increased opening portion can be established. Conversely, it is possible to prevent degradation due to excessive lateral displacement of the evading member by decreasing only the amount of deviation of the evading member in the lateral direction.

In each of the features of the invention, when a liquid having viscosity of less than 30 cps is used, the following effect can be expected: That is, in a case where the liquid contains pigments and therefore agitating members for agitating the liquid are needed in the barrel body; even if the pigments cause sedimentation and adhere to the ball seat and thereabout, there is no possibility that the conducting passage of the liquid would be clogged and the flow of the liquid would be blocked because the area of the opening sections of the longitudinal grooves and the flowing passage are relatively large.

On the other hand, in a case where the liquid contains pigments and therefore agitating members for agitating the liquid are needed in the barrel body; even if the viscosity of a liquid used is less than 30 cps, the liquid can not be expected to serve as a lubricant. However, it is nevertheless possible to improve the flow of the liquid and inhibit the reduction in the amount of liquid ejected by the advantageous effects described above.

When using, for example, a high-viscosity liquid or a liquid whose viscosity increases remarkably with lowering in temperature, it is difficult for the liquid to spontaneously flow out. Even in such a case, by forming the barrel body for the tank of the applying liquid from a flexible material, it is possible to force the liquid to enter the ball house by squeezing the barrel body. Accordingly, it is possible for the applicator using such a high-viscosity liquid to inhibit the reduction in the amount of liquid ejected due to the wear of the ball seat as well as to easily eject the liquid.

In the present invention having features described above, as to the depth of each of the longitudinal grooves, the bottom of each longitudinal grooves is preferably formed outside the edge of the geometric projection of the evading member.

DESCRIPTION OF THE PREFERRED EMBODIMENTS

An embodiment of an applicator of the present invention will hereinafter be described with reference to the accompanying drawings.

Applicators described in the present invention include correcting pens for applying a correcting liquid on an applied surface, writing implements such as a ball-point pen etc., for writing on an applied surface with water-color or oil-based ink, and other applicators which use a liquid such as a cosmetic and the like as an applying liquid.

Figure 1:
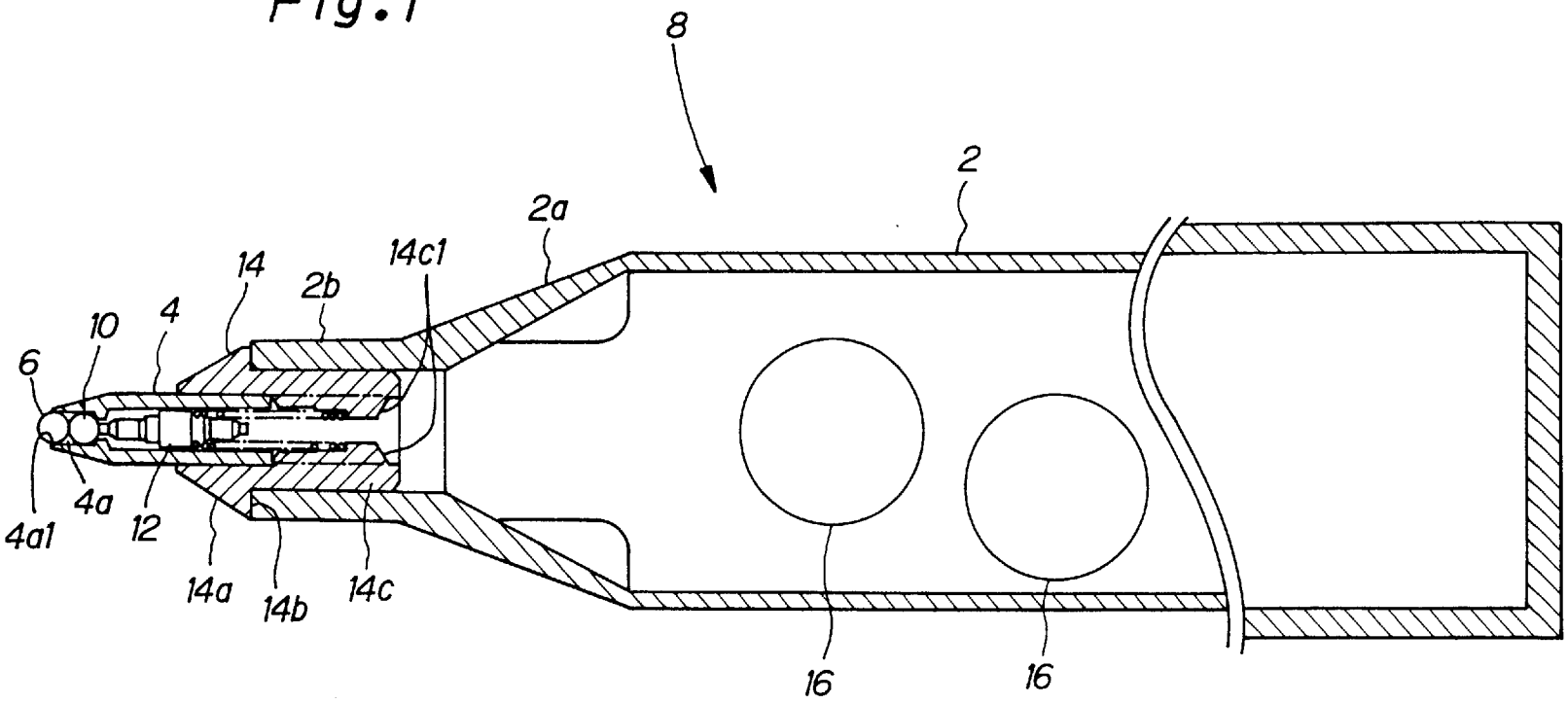
FIG. 1 is a vertical section showing an applicator of a first embodiment of the present invention.
Figure 2:
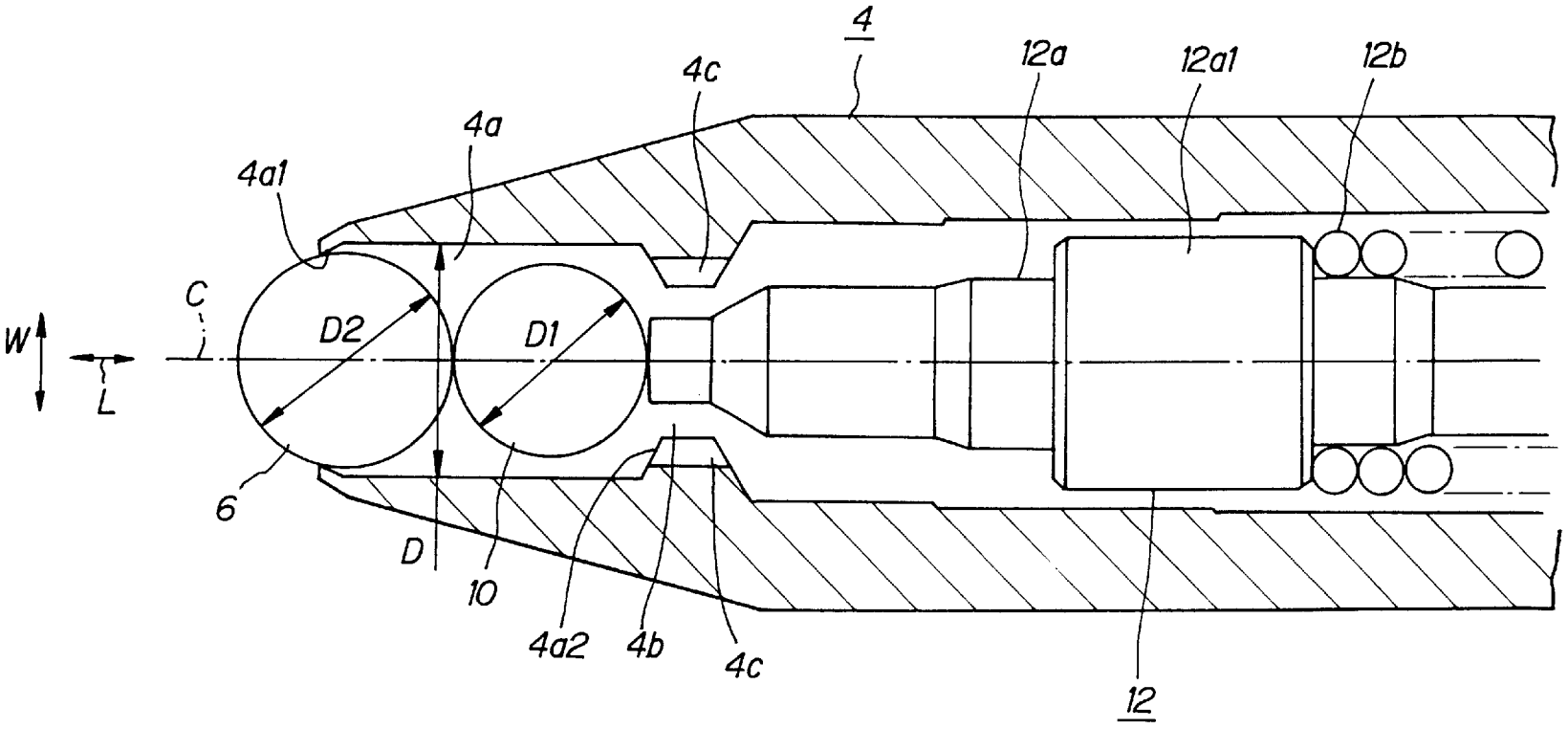
FIG. 2 is an enlarged vertical section of a tip portion of the applicator of the first embodiment, with an ejecting opening closed.
Figure 3:
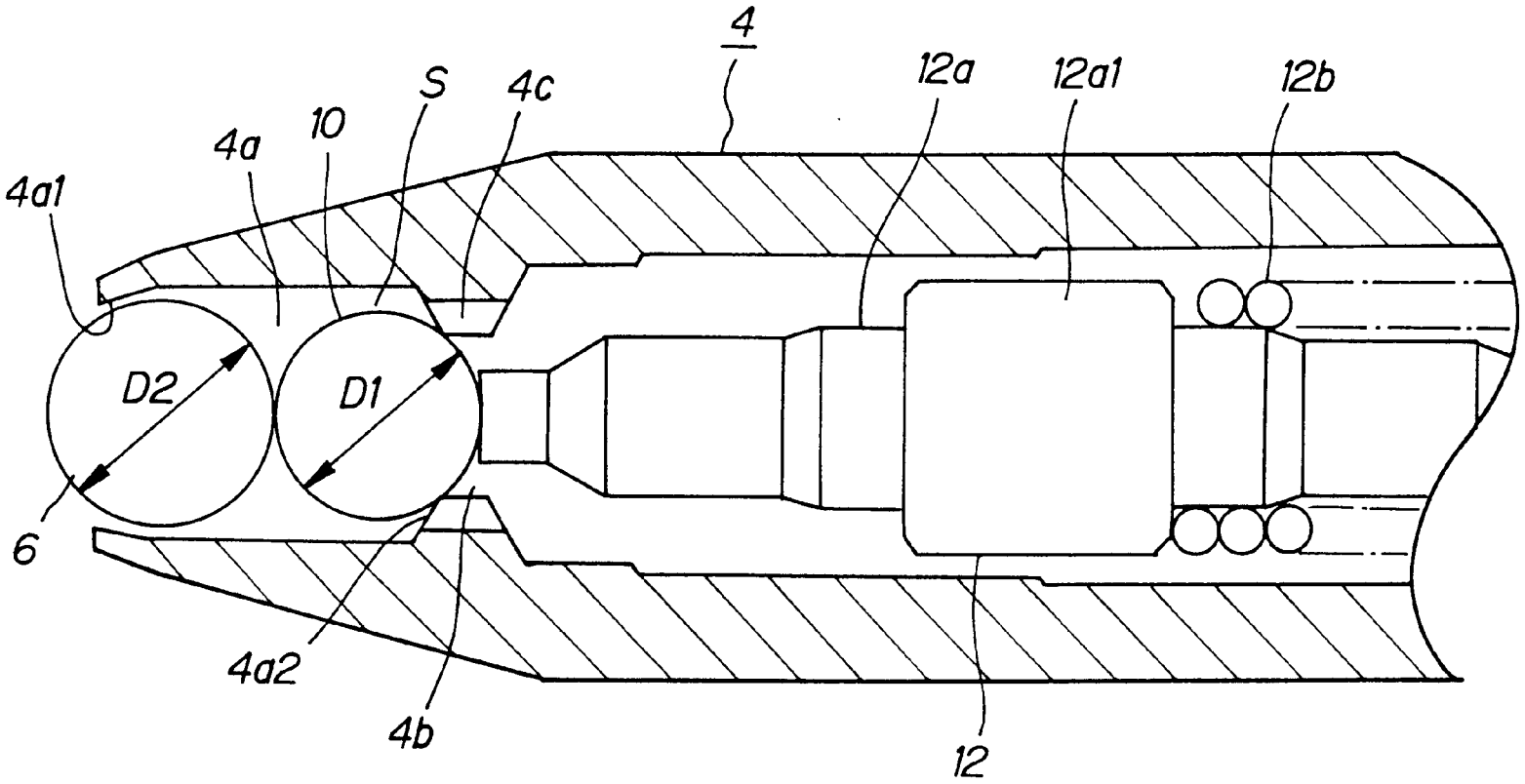
FIG. 3 is an enlarged vertical section of the tip portion of the applicator of the first embodiment, with the ejecting opening opened.

Now, an applicator of a first embodiment will be described. FIG. 1 is a vertical section showing an applicator of the first embodiment. FIGS. 2 and 3 are enlarged vertical sections showing a tip portion of the same applicator; FIG. 2 is a view showing a tip portion of the same applicator; FIG. 2 is a view showing a state in which an ejecting opening is closed, whereas FIG. 3 is a view showing a state in which the ejecting opening is opened.

As shown in FIGS. 1 to 3, an applicator 8 of the first embodiment has a barrel body 2 having a liquid therein; and a mouthpiece 14 attached to the front end of the barrel body 2; and a ball holder 4 which has a ball house 4*a* with an ejecting opening 4*a*1 at its front end through which the liquid flows out from the barrel body 2 and is fitted in the mouthpiece 14. Inside the ball house 4*a*, a ball 6, partially exposed to the outside through the ejecting opening 4*a*1, is rotatably held forming an applying point or surface. This ball 6 is held so as to abut the inner wall around the ejecting opening 4*a*1 and can be moved in such a direction as to be separated from the abutting position, thus the ejecting opening 4*a*1 is closed and opened. That is, when part of the ball 6 is pressed against an applied surface, the clearance is created at the ejecting opening 4*a*1 and allows the liquid to eject out onto the applied surface.

Provided on the rear side of the ball 6 in the ball house 4*a* of this applicator 8 is a spherical evading member 10. This evading member 10, which has a diameter D1 smaller than a diameter D2 of the ball 6, is in contact with the rear side of the ball 6 and is able to move together with the ball 6.

Formed at the rear part of the ball house 4*a* is a ball seat 4*a*2 which receives the rear side of the evading member 10 when part of the ball 6 is pressed against an applied surface so that the ball is moved backward.

A liquid conduit 4*b* for conducting the liquid from the barrel body 2 into the ball house 4*a* is formed in the central portion of the cross-section of the ball seat 4*a*2. A plurality of longitudinal grooves 4*c* radially arranged about the liquid conduit 4*b* as a center, are formed on the inner wall of the liquid conduit 4*b* along the conducting direction of the liquid while a pressing means 12 is disposed through the liquid conduit 4*b*. This pressing means 12 abuts the rear side of the evading member 10 so as to urge the ball 6 and the evading member 10 forward.

Now, configurations of the components will be explained in detail.

The barrel body 2 has a substantially cylindrical shape with a tapered portion 2*a* which is made narrower toward the forward end of the barrel body 2 and a cylinder portion 2*b* which is continuously formed from the front end of the tapered portion 2*a* and opened at the other end. This barrel body 2 serves as a tank for an applying liquid. Since the barrel body 2 has flexibility, when it is squeezed and flexed, the liquid therein can be supplied to the ball house 4*a*.

The mouthpiece 14 is composed of a tapered portion 14*a* in its forward part and a cylindrical portion 14*c* in its rear part; the tapered portion 14*a* has a peripheral side which is made narrower toward the front end while the cylindrical portion 14*c* has a smaller diameter than that at the rear end of the tapered portion 14*a* and is jointed to the rear side of the tapered portion, forming a stepped portion 14*b* between the two parts. A plurality of longitudinal ribs 14*c*1 are formed on the inner wall of the rear part of the cylindrical portion 14*c* in parallel with the central axis of the mouthpiece 14. The thus formed mouthpiece 14 is squeezed into the barrel body 2 until the stepped portion 14*b* abuts the front face of the cylindrical portion 2*b* of the barrel body 2.

The holder 4 has openings at both front and rear ends and takes a form of a cylinder with a tapered part at the front end. This holder 4 is joined to the mouthpiece 14 by squeezing it into the mouthpiece 14 until the rear end of the holder abuts the front ends of the longitudinal ribs 14*c*1 while the front half part of the holder is exposed to the outside.

The ball house 4*a* is hollow, having a circular cross-section, and holds the ball 6 so as to form a clearance that allows the liquid to pass through. A forward opening of the ball house 4*a* or ejecting opening 4*a*1 is generally called a press-fitting portion. This part will be press-fitted to be smaller than the diameter D2 of the ball 6 after the evading member 10 and the ball 6 are inserted into the ball house 4*a*. That is, the ball 6 and the evading member 10 are held and confined inside the ball house 4*a*, but each is rotatable and movable therein. Here, the clearance between the ball 6 and the inside wall of the ball house 4*a* is selected to be suitable for the type of liquid used.

The ball seat 4*a*2 is formed by the inner wall of the holder 4 projecting so that the inner diameter of the ball seat becomes smaller toward the rear that is, the ball seat is a conical surface.

The liquid conduit 4*b* is a hollow having a circular cross-section and has a plurality of longitudinal grooves 4*c*, e.g., six grooves, each depressed below the level of the inner wall of the liquid conduit 4*b* and disposed at intervals of a predetermined distance in the peripheral direction of the liquid conduit 4*b*.

The pressing means 12 is composed of a pressing rod 12*a* and a compressing coil spring 12*b*. The pressing rod 12*a* has a front end that comes through the liquid conduit 4*b* from the rear and abuts the rear side of the evading member 10. The pressing rod 12*a* has a large diameter portion 12*a*1 in a substantially central portion in its length-wise direction. The compressing coil spring 12*b* has a front part fitted on the rear part of the pressing rod 12*a*. The front end of spring 12*b* abuts a stepped face of the large diameter portion 12*a*1 of the pressing rod 12*a*. The rear end of spring 12*b* is caught by the aforementioned ribs 14*c*1.

The evading member 10 is held between the ball 6 and the pressing rod 12*a* with the help of a desired elastic force of the compressing coil spring 12*b*, whereby the center of the ball 6, the center of the evading member 10 and the axis of the pressing rod 12*a* are arranged in a line.

The diameter D1 of the evading member 10 is smaller than that of the ball 6 and is selected to be smaller than the diameter of a circle (on the cross-sectional view) which circumscribes the bottoms of the aforementioned six longitudinal grooves 4*c*.

With the applicator 8 of the first embodiment having components thus configured, the liquid will be applied onto an applied surface such as a paper surface, as follows:

At first, when the user holds the barrel body 2 with the holder 4 down and presses part of the ball 6 onto a paper surface etc., the ball 6 together with the evading member 10 moves rearward opposing the elastic force of the compressing coil spring 12*b* until the evading member 10 abuts the ball seat 4*a*2. In this condition, the liquid inside the barrel body 2 flows down through the passage of the mouthpiece 14 and the space between the inner wall of the holder 4 and the pressing rod 12*a* into the liquid conduit 4*b*. It is also possible to construct the barrel body 2 so that the liquid inside the barrel body 2 may be pushed out into the ball house 4*a* by squeezing the barrel body, as required.

Although the opening of the liquid conduit 4*b* is blocked by the evading member 10, the liquid reaching the liquid conduit 4*b* flows into the ball house 4*a* through the longitudinal grooves 4*c* and advances through the clearance S between the evading member 10 and the ball house 4*a* to the ball 6. The liquid arriving around the ball 6 is ejected out through the clearance between the ejecting opening 4*a*1 and the ball 6 as the ball 6 rolls. At that time, the front end of the holder 4 together with a small part of the ball 6 which comes out through the ejecting opening 4*a*1 and in contact with a paper surface etc., serves as an applying point and the ejected liquid is applied onto the paper surface and the like.

In accordance with the applicator 8 of the first embodiment thus configured and used, when part of the ball 6 is pressed onto the applied surface, the evading member 10 of the smaller diameter moves rearwardly and abuts the ball seat 4*a*2. Therefore, it is possible to establish a greater area of open sections of the longitudinal grooves 4*c* in the ball house 4*a* as compared to the conventional applicator in which a ball of greater diameter is made to directly abut the ball seat. Since the longitudinal grooves 4*c* are formed so that the bottom of each groove is positioned outside the edge of the geometric projection of the evading member 10, an increased area of open sections of the longitudinal grooves 4*c* is yielded, whereby it is possible to supply a great amount of the liquid to the ball house 4*a*.

Further, since the use of the evading member 10 of the smaller diameter creates a greater clearance S between the evading member 10 and the inner wall of the ball house 4*a*, the liquid having passed through the longitudinal grooves 4*c* flows freely through the clearance S to the ball 6.

Moreover, since the evading member 10 of the smaller diameter abuts the ball seat 4*a*2, the reduction of the area of the opening sections of the longitudinal grooves 4*c*, which is due to the wear of the ball seat 4*a*2 caused by repeated applications, is less than that in the aforementioned conventional applicator.

Accordingly, without modifying the diameter D2 of the ball 6 and the inside diameter of the ball house 4*a*, i.e., without increasing the outside dimension of the holder 4, it is possible to improve the flow of the liquid and to prevent a reduction of the amount of the liquid ejected due to the abrasion of the ball seat 4*a*2.

In a case where the liquid contains pigments, agitating balls 16 (as an example of agitating members) for agitating the liquid are required in the barrel body 2 (see FIG. 1). Even if sedimentation of pigments takes place and pigments adhere to the ball seat 4*a*2 and thereabout, there is little possibility that the longitudinal grooves 4*c* would be totally clogged with the built up pigments to thereby block the flow of the liquid because the space around the ball seat 4*a*2 is sufficiently roomy and the area of the opening sections of the longitudinal grooves 4*c* is relatively large.

When the viscosity of a liquid used is less than 30 cps, the liquid cannot be relied on to serve as a lubricant. However, despite the inability of the liquid to lubricate, since the open sections of the longitudinal grooves 4*c* are substantially maintained due to a reduction of wear of the ball seat 4*a*2 as described above, it is still possible to achieve a flow of the liquid sufficient to inhibit reduction of the amount of the liquid ejected.

When using, for example, a high-viscosity liquid or a liquid with which viscosity increases remarkably at lower with temperatures, the liquid may not flow freely out through the liquid conduit 4*b*, longitudinal grooves 4*c* and the clearance between the ball 6 and the inner wall of the ball house 4. Even in such a case, by squeezing the barrel body 2 of the above configuration, the liquid is forced to enter the ball house 4*a*. Accordingly, it is possible for the applicator using such a high-viscosity liquid to inhibit reduction of the amount of the liquid ejected due to the wear of the ball seat 4*a*2 as well as to easily eject the liquid.

Next, second to fourth embodiments will be explained in which the shape of evading members differ from that in the first embodiment.

Figure 4:
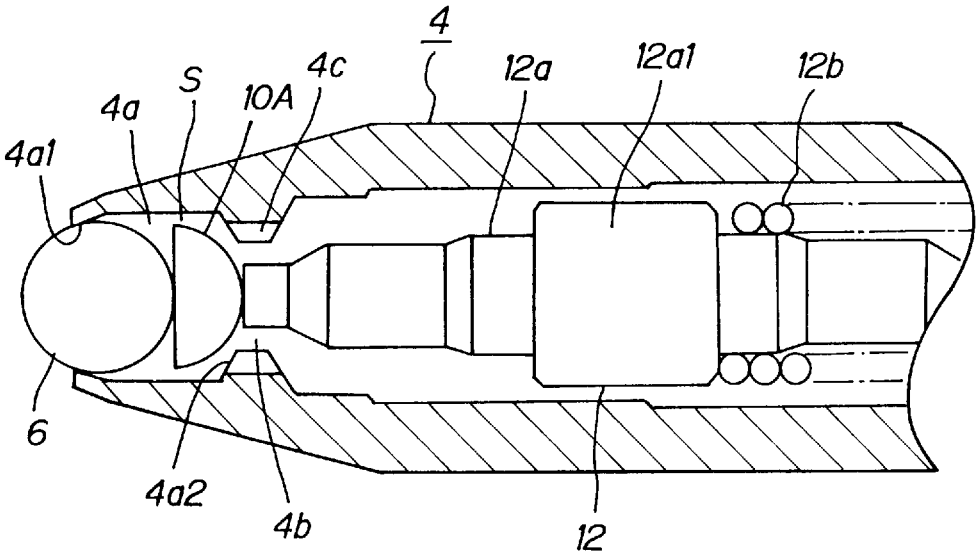
FIG. 4 is an enlarged vertical section of a tip portion of an applicator of a second embodiment, with an ejecting opening closed.
Figure 5:
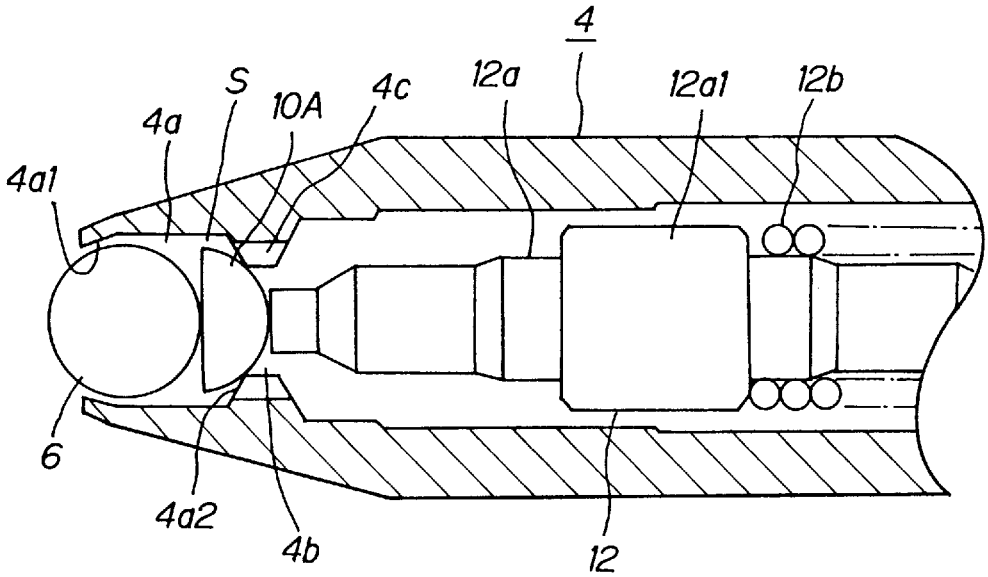
FIG. 5 is an enlarged vertical section of the tip portion of the applicator of the second embodiment, with the ejecting opening opened.

Initially, an applicator of a second embodiment will be described. FIGS. 4 and 5 are enlarged vertical sections showing a tip portion of the applicator of the second embodiment. FIG. 4 shows a state in which an ejecting opening is closed whereas FIG. 5 shows a state in which the ejecting opening is opened.

This second embodiment basically has the same configuration as the first embodiment except that a hemispherical evading member 10A is used in place of the spherical evading member 10. That is, the front end of the pressing rod 12*a* is adapted to abut the spherical part of the evading member 10A while an approximately central point on the plane portion of the evading member 10A is made to abut the rear side of the ball 6.

According to the second embodiment, since the approximately central point on the plane portion of the evading member 10A abuts the rear side of the ball 6, the evading member 10A is unlikely to roll as the ball 6 rotates to apply the liquid. Hence, abrasion of the ball seat 4*a*2 by the evading member 10A is further reduced.

Figure 6:
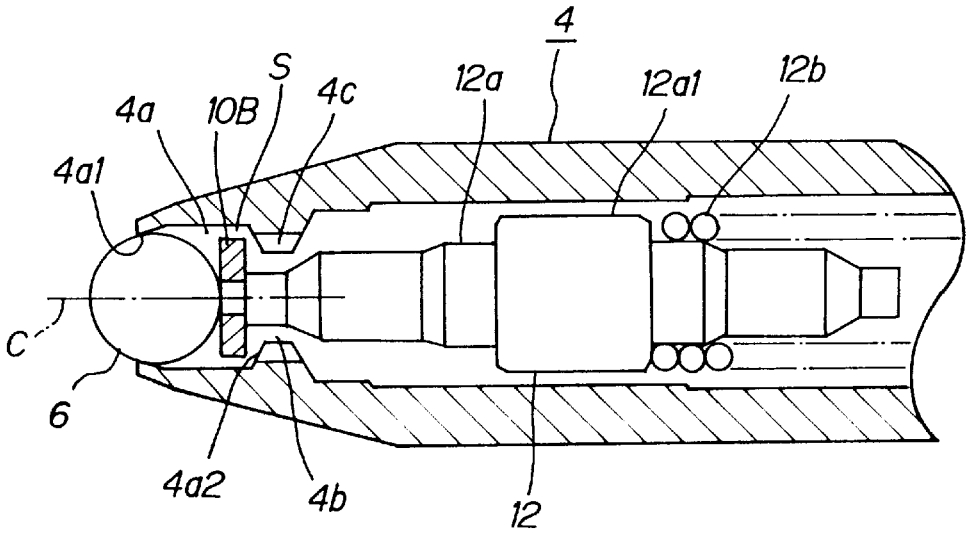
FIG. 6 is an enlarged vertical section of a tip portion of an applicator of a third embodiment, with an ejecting opening closed.
Figure 7:
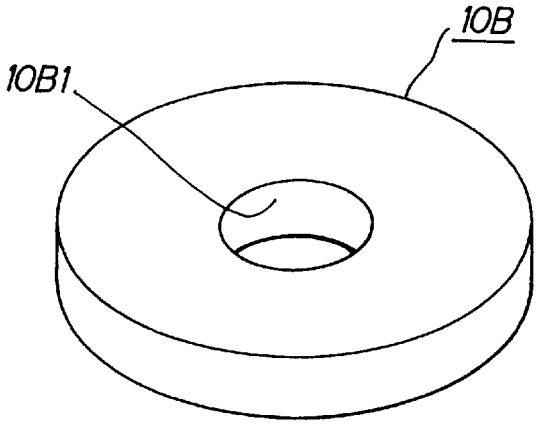
FIG. 7 is an enlarged perspective view showing an evading member of the third embodiment.

Subsequently, an applicator of a third embodiment will be described. FIG. 6 is an enlarged vertical section of a tip portion of the applicator of the third embodiment, in which an ejecting opening is closed. FIG. 7 is a perspective view showing an enlarged evading member in accordance with the third embodiment.

This third embodiment basically has the same configuration as the first embodiment except that an evading member 10B having a disc shape with a circular hole 10B1 in an approximately central portion thereof is provided in place of the spherical evading member 10. The hole 10B1 of the evading member 10B has a smaller diameter than that of the front end part of the pressing rod 12*a* . The ball 6 is adapted to abut the opening brim of the hole 10B1 on the front side of the evading member 10B.

In accordance with the third embodiment, if the ball 6 rotates in contact with the aforementioned opening brim of the hole 10B1, the evading member 10B only rotates in the circumferential direction because of its disc shape.

Accordingly, regardless of the rotating direction of the ball 6, the evading member 10B will only rotate on a central axis C of the ball house 4*a*. As a result, not only can the abrasion of the ball seat 4*a*2 due to the evading member 10B be reduced, but it is also possible for the user to apply the liquid smoothly and comfortably since the ball 6 rotates as guided by the aforementioned opening brim of the hole 10B1.

Figure 8:
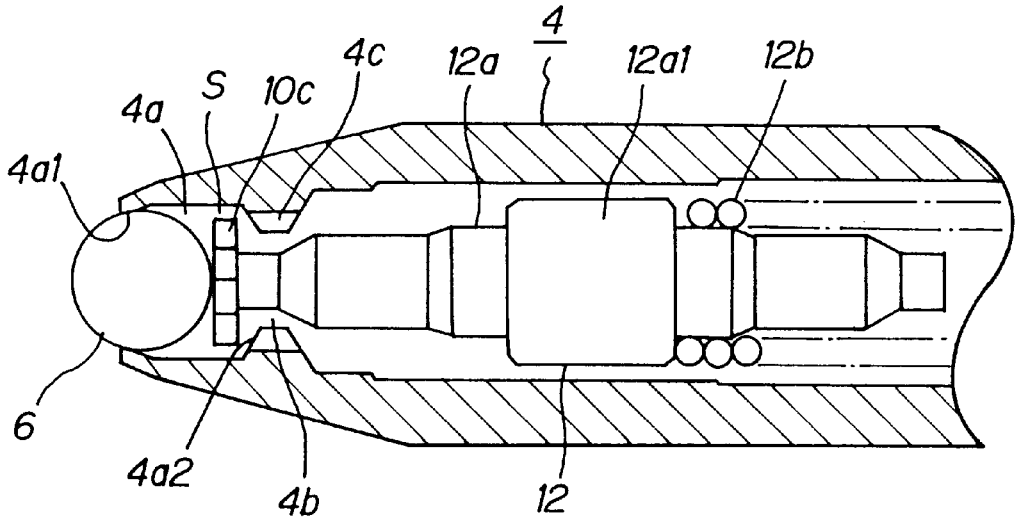
FIG. 8 is an enlarged vertical section of a tip portion of an applicator of a fourth embodiment, with an ejecting opening closed.
Figure 9:
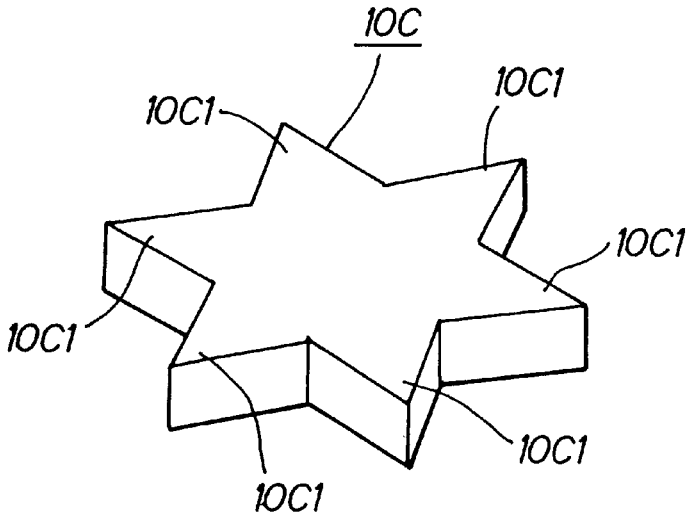
FIG. 9 is an enlarged perspective view showing an evading member of the fourth embodiment.

Next, an applicator of a fourth embodiment will be explained. FIG. 8 is an enlarged vertical section of a tip portion of the applicator of the fourth embodiment of the present invention, in which an ejecting opening is closed. FIG. 9 is a perspective view showing an enlarged evading member in accordance with the fourth embodiment.

This fourth embodiment basically has the same configuration as the first embodiment except that, instead of a spherical evading member 10, an evading member 10C is provided having an approximately star-shaped plate with six projections 10C1 extending in radial directions. The front side of the evading member 10C is in contact with the rear side of the ball 6 while the rear side of the evading member 10C abuts the front end face of the pressing rod 12*a*.

The dimensions of the projections 10C1, specifically, the base width of the projection, the length from the center to the tip of the projection and the like are designated so that the evading member 10C may not drop into the longitudinal grooves 4*c* when the evading member 10C is pressed backward in response to the backward movement of the ball 6.

In accordance with the fourth embodiment, the abrasion of the ball seat 4*a*2 by the evading member 10C can be reduced in the same manner as stated in the third embodiment. Simultaneously, in this case, the liquid having passed through longitudinal grooves 4*c* readily flows into the ball house 4*a* through the troughs between the projections 10C1. Accordingly, it is possible to increase the area of the open sections of the longitudinal grooves 4*c* inside the ball house 4*a*, thus making it possible to further improve the ejection of the liquid.

Figure 10:
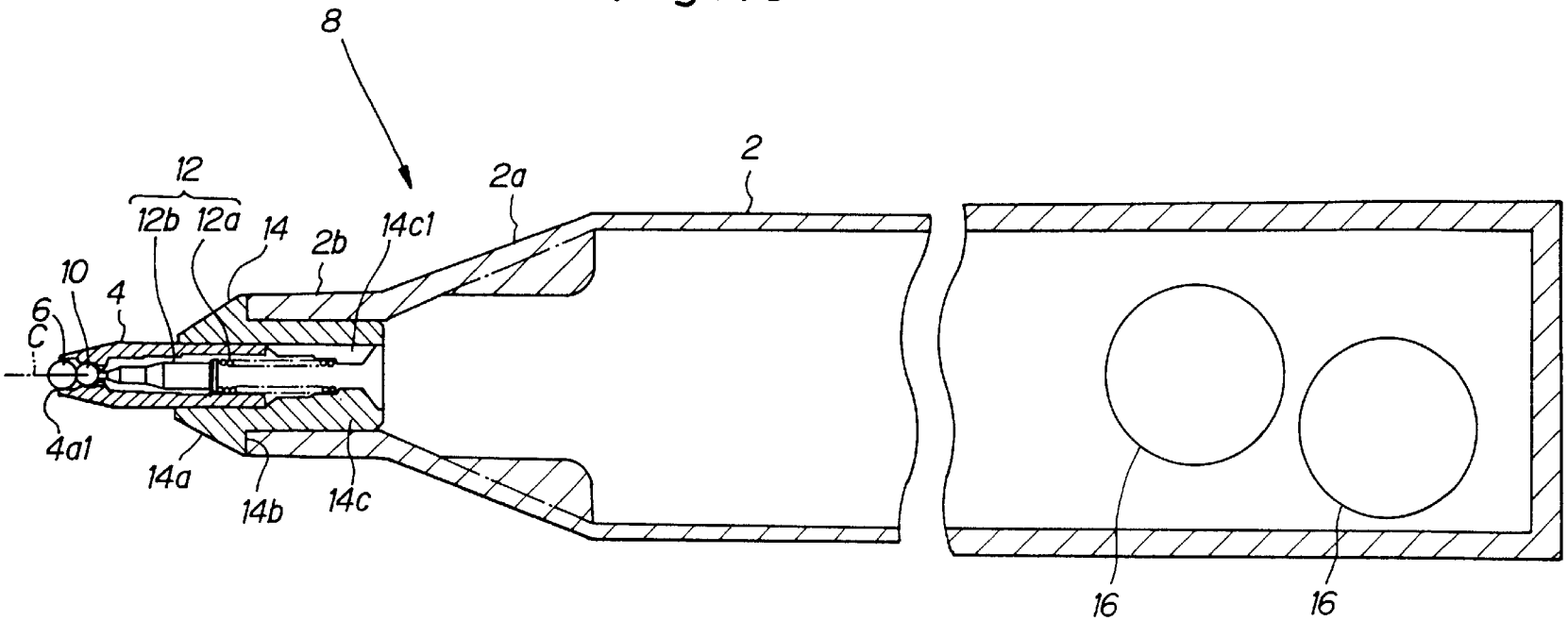
FIG. 10 is a vertical section showing an applicator of a fifth embodiment.
Figure 11:
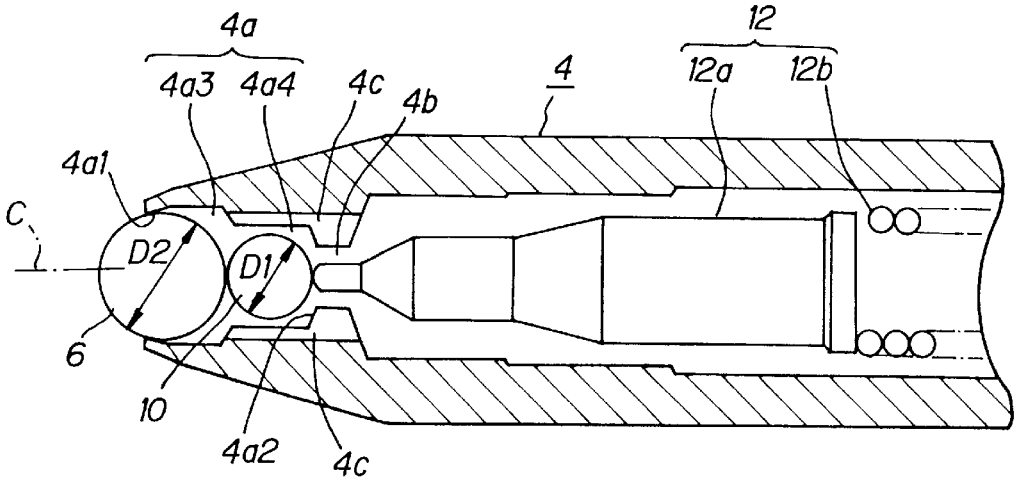
FIG. 11 is an enlarged vertical section of a tip portion of the applicator of the fifth embodiment, with an ejecting opening closed.
Figure 12:
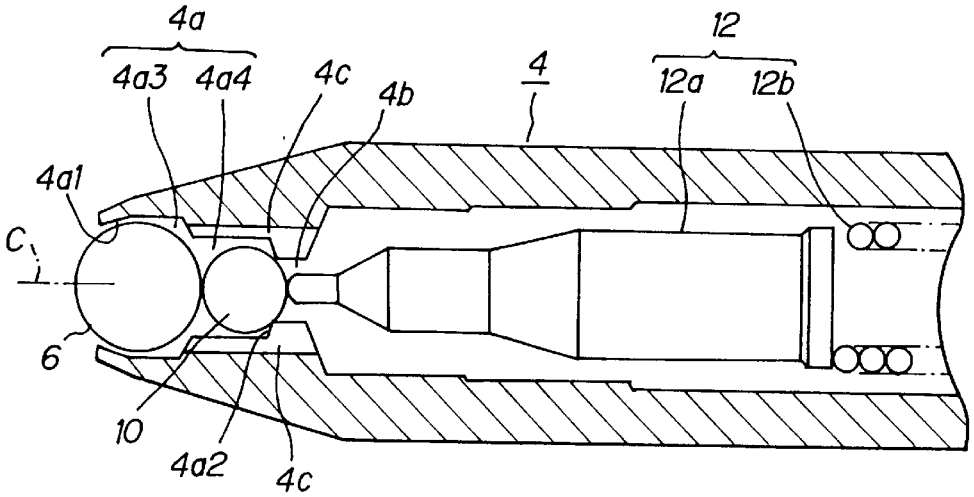
FIG. 12 is an enlarged vertical section of the tip portion of the applicator of the fifth embodiment, with the ejecting opening opened.

Next, FIG. 10 is a vertical sectional view showing an applicator of a fifth embodiment. FIGS. 11 and 12 are enlarged vertical sections showing the tip portion of the applicator; FIG. 11 shows a state in which an ejecting opening is closed and FIG. 12 shows a state in which the ejecting opening is opened.

An applicator 8 of the fifth embodiment basically has the same configuration as that already described as to the first embodiment with reference to FIGS. 1 to 3. Therefore, the description of the same components will be omitted.

A main difference of this applicator 8 of the fifth embodiment from the applicator 8 of the first embodiment is that a ball house 4*a* of this embodiment is that a ball house 4*a* of this embodiment is composed of at least two chambers, one larger and one smaller. That is, the ball house 4*a* comprises a large-diameter ball house 4*a*3 for holding the ball 6 and a small-diameter ball house 4*a*4 for holding an evading member 10. The large diameter ball house 4*a*3 has a greater inside diameter than a diameter D2 of a ball 6. The small diameter ball house 4*a*4 is continuously joined from the rear end of the large-diameter ball house 4*a*3 and has an inside diameter smaller than that of the larger-diameter ball house 4*a*3 and greater than an outside diameter D1 of the evading member 10.

Formed on the rear part of the small-diameter ball house 4*a*4 is a ball seat 4*a*2 for receiving the rear side of the evading member 10 when part of the ball 6 is pressed against an applied surface so that the ball is moved backward.

A liquid conduit 4*b* for conducting the liquid from the barrel body 2 into the ball house 4*a* is formed in a central portion of the cross-section of the ball seat 4*a*2. A plurality of longitudinal grooves 4*c* radially arranged about the liquid conduit 4*b* as a center, are formed on the inner wall of the liquid conduit 4*b* as well as the inner wall of the small-diameter ball house 4*a*4, along the conducting direction of the liquid, while a pressing means 12 is disposed through the liquid conduit 4*b*. This pressing means 12 abuts the rear side of the evading member 10 so as to urge the ball 6 and the evading member 10 forward.

Now, configurations of the components will be explained in detail. As mentioned above, the same configurations already described as to the first embodiment will not be repeated.

Initially, the ball house 4*a* is formed of two chambers having large and small circular cross-sections, respectively. That is, the ball house 4*a* is composed of the large-diameter ball house 4*a*3, which creates a clearance between the ball 6 and the wall thereof to allow the liquid to flow around the ball 6, and the small-diameter ball house 4*a*4, which creates a clearance between the evading member 10 and the wall thereof, to allow the evading member 10 to move forward and backward, or to allow the liquid to flow around the evading member 10.

A forward opening of the ball house 4*a* or ejecting opening 4*a*1 is generally called a press-fitting portion. This part will be press-fitted to be smaller than the diameter D2 of the ball 6 after the evading member 10 and the ball 6 are inserted into the ball house 4*a*. That is, the ball 6 and the evading member 10 can be held and confined inside the ball house 4*a* but each is rotatable and movable therein. Here, the clearance between the ball 6 and the inside wall of the large-diameter ball house 4*a*3 can be selected to accommodate the type of liquid used. The ball seat 4*a*2 is formed by the inner wall of the holder 4 projecting so that the inner diameter of the ball seat becomes smaller toward the rear, that is, the ball seat is a conical surface.

A liquid conduit 4*b* has a circular cross-section. Provided on the inner walls of the liquid conduit 4*b* and the small-diameter ball house 4*a*4 are a plurality of longitudinal grooves 4*c*, e.g., five grooves, each depressed below the surface of the inner walls. The grooves 4*c* are disposed at intervals of a predetermined distance around in the perimeter direction of the liquid conduit 4*b*.

A pressing means 12 is composed of a pressing rod 12*a* and a compressing coil spring 12*b*. A front end of the pressing rod 12*a* comes through the liquid conduit 4*b* from the rear and abuts the rear side of the evading member 10. The compressing coil spring 12*b* has a front end abutting the rear side face of the pressing rod 12*a* and a rear end caught by ribs 14*c*1.

As the operation of applying the liquid onto an applied surface with the applicator 8 of the fifth embodiment having components thus configured is substantially similar to that described in the first embodiment, this operation will hereinafter be described omitting the common actions.

That is, when the user holds the barrel body 2 with the holder 4 down and presses part of the ball 6 onto a paper surface etc., the liquid goes down. By this operation, the opening of the liquid conduit 4*b* is blocked by the evading member 10, in the same manner as stated above, but the liquid reaching the liquid conduit 4*b* flows into the large-diameter ball house 4*a*3 through the longitudinal grooves 4*c* and reaches the ball 6. The liquid arriving around the ball 6 is ejected out through the clearance between the ejecting opening 4*a*1 and the ball 6 as the ball 6 rolls. At that time, the front end of the holder 4 together with a small part of the ball 6 which comes out through the ejecting opening 4*a*1 to contact a paper surface etc., serves as an applying point, and the ejected liquid is applied onto the paper surface and the like.

When the user quits applying, and separates the ball 6 from the paper surface or the like, the evading member 10 is moved forward by the pressing rod 12*a* which is urged by the compressing coil spring 12*b*. Consequently the ball 6 returns to abut the inner wall of the ejecting opening 4*a*1. Since the small-diameter ball house 4*a*4 permits only a small lateral margin or clearance for the evading member 10, the evading member 10 does not deviate significantly from the center and will therefore press a substantially rearmost part of the ball 6. Therefore, the ball 6, because it is not being pressed one-sidedly, moves forward to precisely abut the inner wall of the ejecting opening 4*a*1. Thus it is possible to reliably confine the ejecting opening 4*a*1.

Further, since depressed longitudinal grooves are formed on the inside wall of the small-diameter ball house 4*a*4 in which the evading member 10 is held, the liquid can satisfactorily be supplied around the ball 6.

Moreover, without modifying the diameter D2 of the ball 6 and the inside diameter of the ball house 4*a*, therefore without correspondingly increasing the outside dimension of the holder 4, it is possible to improve the flow of the liquid and to prevent the reduction of the amount of the liquid ejected due to the abrasion of the ball seat 4*a*2.

Since the evading member 10 is held in the small-diameter ball house 4*a*3, the evading member 10 will at all times be substantially aligned with the center of the ball 6 on a center axis C of the barrel body 2. Accordingly, since the evading member 10 will not significantly deviate one-sidedly from the center axis C at the time of applying, it is possible for the user to apply the liquid with good feeling. Since the ball 6 is not pressed one-sidedly, the ejecting opening 4*a*1 can be reliably confined therefore there is no concern that leakage of the liquid or any other defect would occur at the time of non-applying.

When using, for example, a high-viscosity liquid or a liquid whose viscosity increases remarkably with reduction in temperature, it may be difficult for the liquid to freely flow out through the liquid conduit 4*b*, longitudinal grooves 4*c* and the clearance between the ball 6 and the inner wall of the large-diameter ball house 4*a*3. Even in such a case, it is possible with the above configuration for the user to force the liquid to enter the ball house 4*a* by squeezing the barrel body 2. Accordingly, it is possible for the applicator to inhibit the degradation of the amount of the liquid ejected due to the wear of the ball seat 4*a*2 as well as to easily eject a high-viscosity liquid.

Figure 13:
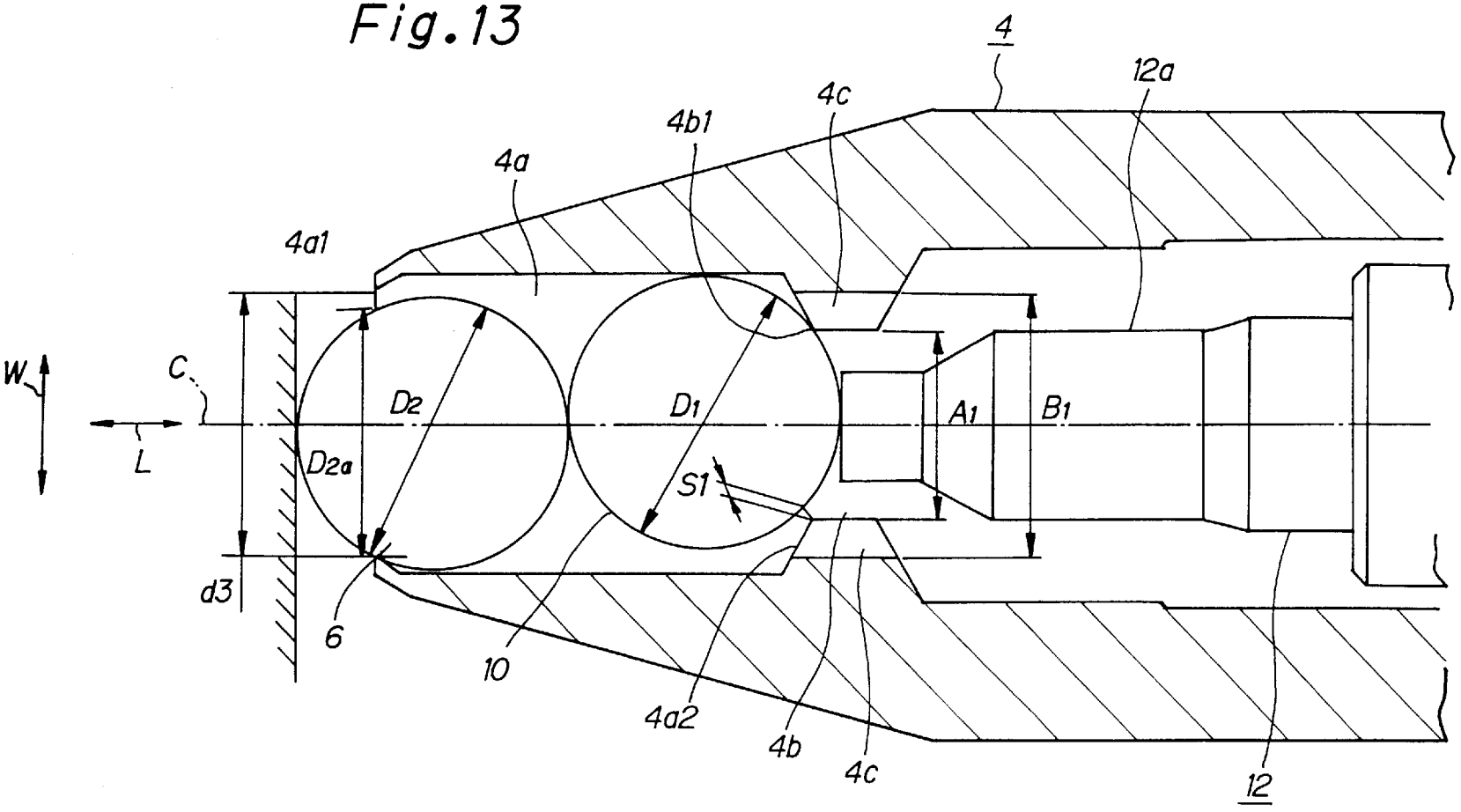
FIG. 13 is an enlarged vertical section of a tip portion of an applicator of a sixth embodiment, with an ejecting opening opened.

Next, sixth and seventh embodiments of the present invention will be described. An applicator of the sixth embodiment basically has the same configuration as that already described with respect to the first embodiment with reference to FIGS. 1 to 2. Therefore, the description of the same components will be omitted. FIG. 13 shows an enlarged vertical view of a tip portion of the applicator of the sixth embodiment for illustrating dimensional relations of components such as an inside diameter of a ball house, a diameter of a ball and the like.

Figure 14:
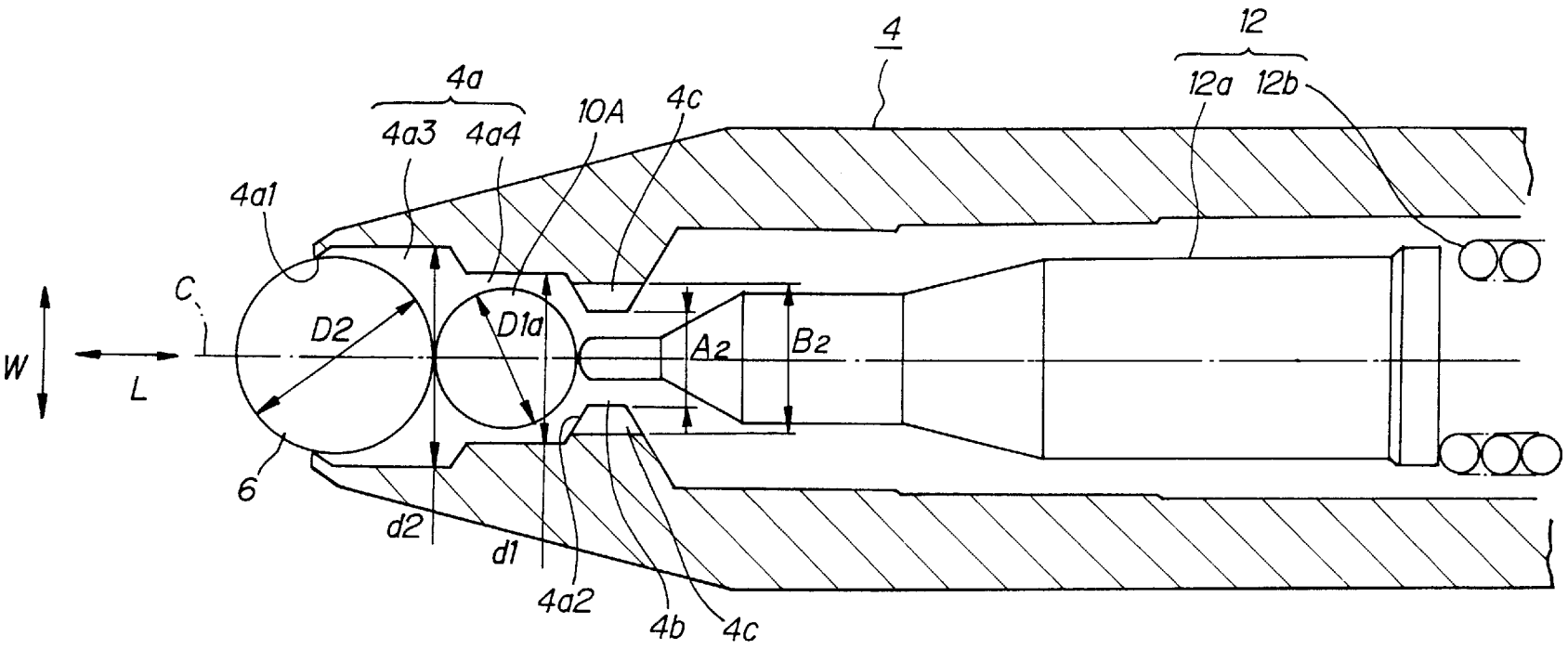
FIG. 14 is an enlarged vertical section of a tip portion of an applicator of a seventh embodiment, with an ejecting opening closed.
Figure 15:
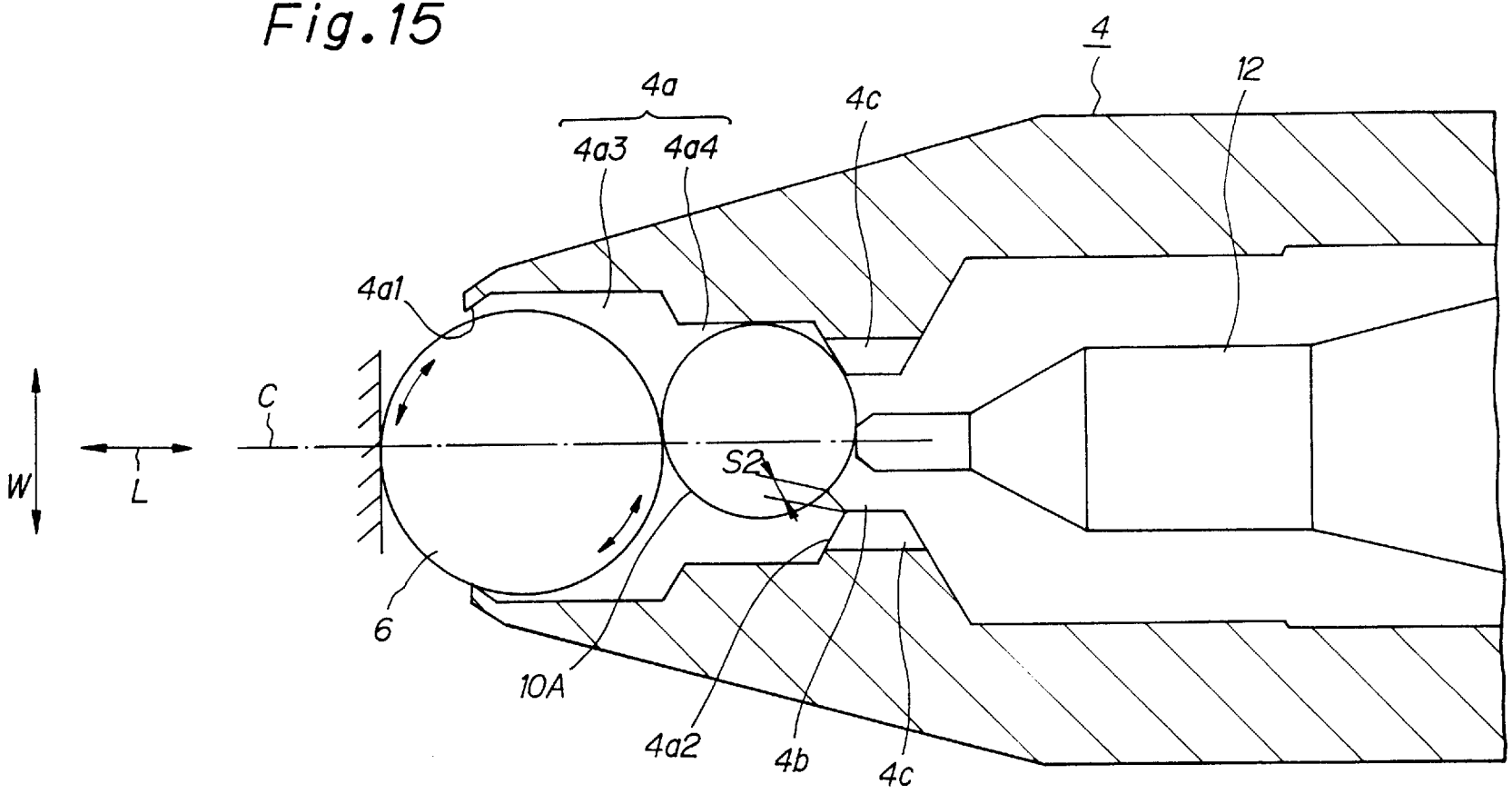
FIG. 15 is an enlarged vertical section of the tip portion of the applicator of the seventh embodiment, with the ejecting opening opened.

FIGS. 14 and 15 are illustrative views for the seventh embodiment. That is, FIGS. 14 and 15 are enlarged vertical sections showing a tip portion of the applicator in accordance with seventh embodiment. FIG. 14 shows a state in which an ejecting opening is closed whereas FIG. 15 shows a state in which the ejecting opening is opened.

At first, the sixth embodiment will be explained.

In the applicator 8, a ball house 4*a* is defined, as shown in FIG. 13, by a substantially cylindrical smooth surface having an inside-diameter D greater than a diameter D2 of a ball 6. Provided on the rear side of the ball 6 in the ball house 4*a* is a ball or an evading member 10 having a diameter D1 which is approximately equal to the diameter D2 of the ball 6. This evading member 10 is arranged in such a manner as to abut the rear side of the ball 6 and be movable together with the ball 6.

The ball house 4*a* has a circular cross-section with a smooth inner surface, as shown in FIG. 13 and has a clearance between the ball 6 and the inside wall thereof for allowing the liquid to flow around the ball. A forward opening of the ball house 4*a*, an ejecting opening 4*a*1 is generally called a press-fitting portion. This part will be press-fitted to be smaller than the diameter D2 of the ball 6 after the evading member 10 and the ball 6 are inserted into the ball house 4*a*. That is, the ball 6 and the evading member 10 are held and confined inside the ball house 4*a* but each is rotatable and movable therein.

A pressing means 12 is composed of a pressing rod 12*a* and a compressing coil spring 12*b*. A front end of the compressing rod 12*a* extends through the liquid conduit 4*b* from the rear and abuts the rear side of the evading member 10. Pressing rod 12*a* has a large diameter portion 12*a*1 in a substantially central portion in its length-wise direction. The compressing coil spring 12*b* has a front part fitted on the rear part of the pressing rod 12*a* with a front end abutting a stepped face of the large diameter portion 12*a*1 and a rear end caught by ribs 14*c*1. The pressing means is not intended to be limited to the pressing means 12 shown. For example, a spring member such as a leaf spring, or a forwardly tapered compressing coil spring may directly abut the rear side of the evading member 10.

The evading member 10 is held between the ball 6 and the pressing rod 12*a* with the help of a desired elastic force of the compressing coil spring 12*b*, whereby the center of the ball 6, the center of the evading member 10 and the axis of the pressing rod 12*a* are arranged in a line.

In the sixth embodiment, the diameter D2 of the ball 6 and the diameter D1 of the evading member 10 are set to be (ϕ1.0 mm while the inside diameter D of the ball house 4*a* is ϕ1.1 mm. The ball 6 and the evading member are movable along the length-wise direction L for a distance of 0.1 mm. The ball 6 is movable in the lateral direction W at right angles to the axis for a distance of about 0.04 mm from the center. The evading member 10 in the lateral direction W at right angles to the axis for a distance of about 0.05 mm from the center. An inside-diameter A1 of the liquid conduit 4*b* is ϕ0.7 mm. A distance B1 between bottoms of opposing longitudinal grooves 4*c* is 1.0 mm.

Here, the aforementioned movable distance of the ball 6 in the lateral direction W at right angles to the axis is determined by the clearance which is created between the ball 6 and the brim of the ejecting opening 4*a*1 at the time of applying, or in a condition where the evading member 10 is moved backward and abuts the ball seat 4*a*2. In this sixth embodiment, the ball 6 is movable along the length-wise direction for a distance of 0.1 mm and an inside diameter d3 of the ejecting opening 4*a*1 is set to be ϕ0.955 mm. In this arrangement, when the ball 6 is in a rearmost position, a diameter D2*a* (see FIG. 13) of an intersecting circle between the ball 6 and a plane including the edge of the ejecting opening 4*a*1 is 0.866 mm. Accordingly, the ball 6 is movable in the lateral direction W at right angles to the axis for a distance of 0.089 mm from one extreme to the other extreme, or 0.044 mm≅0.04 mm from the center. The evading member 10 is movable in the lateral direction for a distance calculated by the inside diameter D of the ball house 4*a* and the diameter D1 of the evading member 10, regardless of the inside diameter d3 of the ejecting opening 4*a*1.

Here, the above-mentioned numerals can adaptively be modified depending upon the type of a liquid used and the diameters of the ball and evading member used. The ball 6 and the evading member 10 are most preferably composed of a cemented carbide or may be formed of a stainless steel. A hard plastic may be used only for the evading member 10.

When the liquid is applied on an applied surface such as a paper surface by using the applicator 8 of the sixth embodiment thus configured, the following effects can be obtained.

At first, when the user holds the barrel body 2 with the holder 4 down and presses part of the ball 6 onto a paper surface etc., the ball 6 together with the evading member 10 moves rearwardly, opposing the elastic force of the compressing coil spring 12*b* until the evading member 10 abuts the ball seat 4*a*2. In this condition, as the ball 6 is moved while pressed against the applied surface, the ball 6 rotates but the evading member hardly rotates for the following reasons 1; ) to 3):

1) The liquid which comes between the ball 6 and the evading member 10 serves as a lubricant, to thereby reduce the frictional force at the contact between the two.
2) The spherical evading member 10 comes in contact with the ball 6 at a single point.
3) Since both the ball 6 and the evading member 10 are spherical, it is possible to readily produce these parts with high sphericity. Accordingly, it is possible to achieve improved surface smoothness in producing the both elements, therefore it is possible to further reduce the friction therebetween.

Because of the above reasons 1) to 3), the ball 6 rotates, skidding relative to the evading member 10 so that the rotation will hardly be transferred to the evading member 10, as shown in FIG. 13. As a result, the ball seat 4*a*2 is hardly worn down by the evading member 10, therefore the area of opening sections of longitudinal grooves 4*c* formed on the inside wall of the liquid conduit 4*b* will vary little.

Further, since, as shown in FIG. 13, the evading member 10 and the ball 6 are able to move both in the length-wise direction L and the lateral direction W inside the ball house 4*a*, when the ball 6 is pressed against an applied surface and moved backward at the time of applying, the evading member 10 will abut the inside wall of the ball house 4*a* and the ball seat 4*a*2 with its center to one side the central axis C of the ball house 4*a* in the lateral direction (to the upper side in FIG. 13).

As a result, the opening brim designated at 4*b*1 of the liquid conduit 4*b* will not be completely blocked by the rear side of the evading member 10. That is, a gap S1 will be formed between the opening brim 4*b*1 and the evading member 10, as shown in FIG. 13. The gap S1 is about 0.07 mm in the sixth embodiment. In this arrangement, the liquid stored in the barrel body 2, flowing through the passage of the mouthpiece 14 and the channel between the inside wall of the holder 4 and the pressing rod 12*a*, advances into the ball house 4*a* both through the longitudinal grooves 4*c* and the liquid conduit 4*b*. In other words, the supplying of the liquid to the ball 6 and the ejecting opening 4*a*1 can be done not only through the longitudinal grooves 4*c* but also through the liquid conduit 4*b*, whereby a further improved flowing condition of the liquid can be achieved.

Then, the liquid, passing through the clearance between the evading member 10 and the inner wall of the ball house 4, reaches the ball 6, and is ejected through the gap between the ejecting opening 4*a*1 and the ball 6 as the ball rolls. At that time, the front end of the holder 4 together with a small part of the ball 6 which comes out through the ejecting opening 4*a*1 and in contact with a paper surface etc., serves as an applying point and the ejected liquid is applied onto the paper surface and the like. It is also possible to construct the barrel body 2 so that the liquid inside the barrel body 2 may be pushed out into the ball house 4*a* by squeezing the barrel body, as required.

In accordance with the sixth embodiment thus configured, it is possible for the applicator 8 to maintain an initially designated ejecting flow of the liquid even after usage for a prolonged period of time.

The pressing means 12 urges the evading member 10 and the ball 6 forward. This enhances the sealing performance between the ball 6 and the ejecting opening 4*a*1 so as to reliably confine and open the ejecting opening 4*a*1. Consequently, it is also possible to prevent liquid leakage and other deficiencies.

Next, an applicator of a seventh embodiment will be explained with reference to FIGS. 14 and 15.

The embodiment basically has a similar configuration to that of the sixth embodiment and is an improved variation of the sixth embodiment. The improved point is that an evading member 10A having a diameter D1*a* smaller than the diameter D2 of the ball 6 is disposed behind the ball 6 inside the ball house 4*a* so that the evading member 10A is in contact with the rear side of the ball 6 and movable together with the ball 6.

The ball house 4*a* is composed of a large-diameter ball house 4*a*3 and a small diameter ball house 4*a*4. The large diameter ball house 4*a*3 has an inside diameter d2 greater than the diameter D2 of the ball 6, and holds the ball 6. The small-diameter ball house 4*a*4 holds the evading member 10, and is continuously joined to the rear end of the large-diameter ball house 4*a*3. The small diameter ball house 4*a*4 has an inside diameter d1 smaller than the inside diameter d2 of the large-diameter ball house 4*a*3 and greater than the diameter D1*a* of the evading member 10. Each of the large-diameter ball house 4*a*3 and the small-diameter ball house 4*a*4 is formed with an approximately cylindrical smooth inner surface.

Formed in the rear part of the small-diameter ball house 4*a*4 is a ball seat 4*a*2 for receiving the rear part of the evading member 10A when part of the ball 6 is pressed on an applied surface so that the ball is moved backward. A liquid conduit 4*b* for conducting the liquid from the barrel body 2 into the ball house 4*a*is provided in an approximately central part of the ball seat 4*a*2. A plurality of longitudinal grooves 4*c* radially arranged about the center of the liquid conduit 4*b*, are formed on the inner wall of the liquid conduit 4*b*, along the conducting direction of the liquid.

In this seventh embodiment, the diameter D2 of the ball 6 is ϕ1.0 mm while the diameter D1*a* of the evading member 10A is ϕ0.7 mm. The inside diameter d2 of the large-diameter ball house 4*a*3 is 1.1 mm while the inside diameter d1 of the small-diameter ball house 4*a*4 is ϕ0.85 mm. The ball 6 and the evading member are each movable along the length-wise direction L for a distance of 0.1 mm. The ball 6 is movable in the lateral direction W at right angles to the axis for a distance, similarly to the first embodiment, of about 0.04 mm from the center. The evading member 10A is movable in the lateral direction W at right angels to the axis for a distance of about 0.075 mm from the center. An inside-diameter A2 of the liquid conduit 4*b* is ϕ0.42 mm. A distance B2 between bottoms of opposing longitudinal grooves 4*c* is 0.75 mm. The same material represented in the aforementioned sixth embodiment can be used for forming the ball 6 and the evading member 10A.

In accordance with the applicator of the seventh embodiment thus configured, since the ball house 4*a* is constructed of the large-diameter ball house 4*a*3 and the small-diameter ball house 4*a*4, it is possible to select the distance the evading member 10A will move in the lateral direction W by selecting only the inside diameter d1 of the small-diameter ball house 4*a*4 and the diameter D1*a* of the evading member 10A. Needless to say, the same effects as stated in the sixth embodiment can be expected.

In the seventh embodiment, regardless of the amount of movement of the ball 6 in the lateral direction, which is a factor of affecting smoothness and comfort in applying, the amount of movement of the evading member 10A in the lateral direction W is set up to be 0.075 mm from the center, as stated above. In this setup condition, when the applicator is used for applying and the evading member 10A is made to abut the inner wall of the small-diameter ball house 4*a*4 and the ball seat 4*a*2, it is possible to establish a greater displacement of the evading member 10A in the lateral direction to one side (to the upper side in FIG. 15). Specifically, a larger gap S2 of about 0.09 mm can be secured. Accordingly, the opening portion of the liquid conduit 4*b* (a substantially crescent-shaped opening if it is viewed from the front) can be further increased, whereby it is possible to achieve an improved ejection of the liquid.

Although the seventh embodiment was constructed such that improved ejection of the liquid would be obtained by increasing the amount of movement of the evading member 10A in the lateral direction W, it is also possible to select the inside diameter d1 of the small-diameter ball house 4*a*4 and the diameter D1*a* of the evading member 10A so that the amount of movement of the evading member 10A in the lateral direction W may be small. By this selected condition, it is also possible to prevent degradation due to the excessive displacement of the evading member 10A in the lateral direction W.

As to the applicators of the second through seventh embodiments, in a case where the liquid contains pigments, agitating balls 16 (as an example of agitating members) for agitating the liquid are provided in the barrel body 2 (see FIG. 1), similarly to the first embodiment. Even if pigments cause sedimentation and adhere to the ball seat 4*a*2 and thereabout, the area of opening sections of the longitudinal grooves 4*c* will not vary very much by virtue of the operation described above wherein the liquid can be supplied through the liquid conduit 4*b* as stated above. Accordingly, adhered material, if any, can be removed quickly. Consequently, there is no possibility that the conducting passage of the liquid would be clogged thereby blocking the flow of the liquid.

When the viscosity of the liquid used is less than 30 cps, the liquid cannot be expected to serve as a lubricant. Since, as mentioned above, the reduction of the area of the opening sections of the longitudinal grooves 4*c* due to wear of the ball seat 4*a*2 is reduced, it is possible to secure a good flow of the liquid and therefore it is possible to inhibit the lowering of the amount of the liquid ejected.

When using, for example, a high-viscosity liquid or a liquid whose viscosity increases remarkably at lower temperatures, the liquid may not freely flow out through the liquid conduit 4*b*, longitudinal grooves 4*c* and the clearance between the ball 6 and the inner wall of the ball house 4. Even in such a case, by squeezing the barrel body 2 of the above configuration the liquid is forced to enter the ball house 4*a*. Accordingly, it is possible for the applicator using such a high-viscosity liquid to inhibit the degradation of the amount of the liquid ejected due to the wear of the ball seat 4*a*2, as well as to easily eject the liquid.

In accordance with the above embodiments, even when the liquid is of low-viscosity or contains pigments, it is possible to prevent the lowering of the amount of the liquid ejected which would be caused by repeated applications, and to maintain good ejection of the liquid, without enlarging the outside diameter of the holder 4. When using a liquid which does not freely flow, it is possible to readily eject such a liquid as well as to prevent the lowering of the amount of the liquid ejected, to thereby maintain good ejection of the liquid. Further, it is possible to reliably confine and open the ejecting opening 4*a*1 and achieve improved application.

While the applicators of the present invention have been described in preferred embodiments, these embodiments are not intended to limit the technological scope of the present invention.

As has been stated heretofore, in accordance with the applicators of the present invention, even when the liquid is of low-viscosity or contains pigments, it is possible to inhibit the lowering of the amount of the liquid ejected which would be caused by repeated applications, and it is also possible to eject a proper amount of the liquid, without enlarging the outside diameter of the holder. When using a liquid which does not flow freely, it is possible to readily eject such a liquid as well as to inhibit the lowering of the amount of the liquid ejected, to thereby eject the liquid at a sufficient rate. Further, reliable opening and closing of the ejecting opening can be secured and consequently, the applicator of the present invention is free from liquid leakage and other deficiencies and is able to provide improved application for users.

What is claimed is:

1. An applicator comprising:

a barrel body storing a liquid therein;

a ball holder having a ball house defined by a cylindrical inner surface having an inside diameter and a longitudinal axis, said ball house having an ejecting opening having an inside diameter smaller than said inside diameter of said ball house, said ejecting opening being surrounded by an inner wall at a front end of said ball holder, said ejecting opening allowing the liquid from said barrel body to flow out of said applicator;

a ball rotatably held in said ball house, said ball being partially exposed to the outside through said ejecting opening so as to serve as an applying point, said ball being held movably between a first position centered on said longitudinal axis and abutting said inner wall around said ejecting opening, and a second position laterally offset from said longitudinal axis and separated from the abutting position, whereby said ejecting opening is closed and opened, wherein, when part of said ball is pressed on an applied surface, said ball is moved rearward from the abutting position and laterally from the longitudinal axis such that said ball is separated from the abutting position and the liquid is ejected from a gap between said ejecting opening inner wall and said ball to thereby apply the liquid on the applied surface, said ball having a diameter less than the diameter of said ball house;

a spherical evading member disposed on the rear side of said ball inside said ball house, a front side of said evading member being in contact with the rear side of said ball and movable together with said ball rearward to a position laterally offset from the longitudinal axis;

a ball seat disposed in the rear part of said ball house, said ball seat centered on said longitudinal axis, said ball seat receiving the rear side of said evading member when part of said ball is pressed against an applied surface so that said ball is moved backward into contact with a front side of said evading member, and a rear side of said evading member is pressed into contact with said ball seat and is laterally offset from the longitudinal axis, such that a gap is formed between a portion of the evading member and a portion of the ball seat;

a liquid conduit provided in a central part of said ball seat, for conducting the liquid from said barrel body into said ball house;

a plurality of longitudinal grooves radially arranged about said liquid conduit as a center, said grooves being formed on the inner wall of said liquid conduit along the conducting direction of the liquid along said longitudinal axis; and a pressing means disposed through said liquid conduit and abutting the rear side of said evading member so as to urge said evading member forward into contact with said ball to urge said ball forward into the abutting position.

2. An applicator according to claim 1, wherein said liquid has viscosity of less than 30 cps.

3. An applicator according to claim 2, wherein said liquid contains pigments, said applicator further comprising an agitating means for agitating the liquid provided inside said barrel body.

4. An applicator according to claim 1, wherein said liquid contains pigments, said applicator further comprising an agitating means for agitating the liquid provided inside said barrel body.

5. An applicator according to claim 1, wherein said barrel body is a flexible tank for storing an applying liquid.

6. An applicator according to claim 1, wherein said spherical evading member has a diameter approximately equal to the diameter of said ball.

7. An applicator according to claim 1, wherein said longitudinal grooves have bottom portions, the distance between opposing bottom portions being greater than the diameter of said evading member so that ink flows past said evading member when said rear side of said evading member is pressed into contact with said ball seat.

8. An applicator according to claim 1, wherein when said rear side of said evading member is pressed into contact with said ball seat, the center of said evading member is offset from said longitudinal axis so that liquid flows through said liquid conduit and said longitudinal grooves and past said evading member and said ball to flow out of said ejecting opening.

9. An applicator according to claim 1, wherein said pressing means is a pressing rod having a biasing element.

10. An applicator according to claim 1, wherein:

said ball house comprises at least two chambers;

a first of said at least two chambers has a first diameter larger than the diameter of said ball, said ball being positioned in said first of said at least two chambers; and a second of said at least two chambers has a second diameter larger than the diameter of said evading member and smaller than said first diameter of said first chamber, said evading member being positioned in said second of said at least two chambers.

11. An applicator according to claim 10, wherein:

said longitudinal grooves have bottom portions, the distance between opposing bottom portions being greater than the diameter of said evading member so that ink flows past said evading member when said rear side of said evading member is pressed into contact with said ball seat;

said second chamber is defined by an inside wall having longitudinal grooves; and liquid passes through said longitudinal grooves of said liquid conduit and said longitudinal grooves of said second chamber and past said evading member and said ball to flow out said ejecting opening.

12. An applicator according to claim 1, wherein said evading member has a diameter smaller than the inside diameter of said ball house to provide a clearance between said evading member and said cylindrical surface of said ball house for the passage of the liquid.

* * * * *